US006931976B2

(12) United States Patent
Yang

(10) Patent No.: US 6,931,976 B2
(45) Date of Patent: Aug. 23, 2005

(54) DEVICE FOR PATTERNING AN OPTICAL ELEMENT

(76) Inventor: Pang-Lun Yang, 3F-2, No. 2, Lane 71, Szu Wei Road, Wu Chi Chen, Taichung Hsien (TW)

( * ) Notice: Subject to any disclaimer, the term of this patent is extended or adjusted under 35 U.S.C. 154(b) by 42 days.

(21) Appl. No.: 10/747,353

(22) Filed: Dec. 29, 2003

(65) Prior Publication Data

US 2004/0149117 A1 Aug. 5, 2004

(Under 37 CFR 1.47)

(30) Foreign Application Priority Data

Dec. 27, 2002 (TW) ..... 91137717 A

(51) Int. Cl.[7] ..... B26D 3/06; B26D 7/26

(52) U.S. Cl. ..... 83/875; 83/879; 83/854; 83/558; 83/563; 125/23.01

(58) Field of Search ..... 83/875, 879, 554, 83/558, 563; 125/23.01

(56) References Cited

U.S. PATENT DOCUMENTS 6,239,851 B1 * 5/2001 Hatazawa et al. ..... 349/62
6,398,610 B1 * 6/2002 Inoue ..... 445/66
6,619,175 B2 * 9/2003 Yoo ..... 83/875
2002/0056355 A1 5/2002 Yoo
2002/0059860 A1 5/2002 Yoo

* cited by examiner

*Primary Examiner*—Charles Goodman
(74) *Attorney, Agent, or Firm*—Ladas & Parry LLP

(57) ABSTRACT

A device for patterning an optical element includes a working platform, a linear cutting pedestal, at least a cutting tool, at least a weight sliding block and a shaft. An optical element to be patterned is carried on the working platform. The working platform is driven to move horizontally. The linear cutting pedestal is mounted above the working platform. An upper sliding track in which the weight sliding blocks can move back and forth and provide appropriate press forces to the cutting tools, is disposed at the top of the linear cutting pedestal. A lower sliding track in which the cutting tools can move back and forth and be adjusted to appropriate positions according to patterns desired for the optical element, is disposed at the bottom of the linear cutting pedestal. The shaft is positioned above the linear cutting pedestal and drives the linear cutting pedestal to move vertically. By means of a linear relative motion of the working platform to the linear cutting pedestal, the cutting tools at the bottom of the linear cutting pedestal cut out grooves on the optical element.

10 Claims, 4 Drawing Sheets

DEVICE FOR PATTERNING AN OPTICAL ELEMENT

FIELD OF THE INVENTION

The present invention relates to a device for patterning an optical element, more particularly, to a device having a single shaft and multiple cutting tools in which device the cutting forces of the cutting tools applied onto the optical element can be adjusted by weight sliding blocks.

BACKGROUND OF THE INVENTION

With rapid advancement of the fabrication technology of a thin film transistor liquid crystal display (TFT-LCD), the LCD is largely applied in various electronic products such as a Personal Digital Assistant (PDA) device, a notebook computer, a digital camera, a video camera, and a mobile phone due to the fact it has advantages of smaller size, lighter weight, lower power consumption and low radiation. Moreover, since the related manufacturers aggressively invest in research & development and employ large-scale fabricating equipment, the quality of the LCD is unceasingly improved and the price thereof is continuously decreased. This promptly broadens the applied fields of the LCD.

Since the LCD is not a light-emitting display apparatus, it performs a display function with the aid of a back light module. Please refer to FIG. 1 illustrating a sectional view of the back light module 10. The back light module 10 comprises a light guiding plate 11, a reflective plate 12, a lamp 13, a plurality of optical thin films 14 and a frame 15. The light guiding plate 11 and these optical thin films 14 are made of acrylic materials by injection or extrusion. Patterns as diffusion dots 16 for scattering light are formed on the bottom surface of the light guiding plate 11 and the surface of the optical thin films 14 for improving the brightness and the viewing angle of the LCD. The reflective plate 12 is disposed beneath the light guiding plate 11 and can reflect the light coming out from the light guiding plate 11 to return the light to the light guiding plate 11 for increasing the utilization of light. The lamp 13 is mounted at one side of the light guiding plate 11 and transmits lights into the light guiding plate 11 via one end of the the light guiding plate 11. The lamp 13 is generally composed by a cold cathode fluorescent lamp (CCFL). The frame 15 is mounted at the bottom and the sides of the back light module 10 for protecting the back light module 10 and the elements therein.

U.S. patent application Ser. Nos. 09/766,774 and 09/766,914 disclose two inventions relating to methods and apparatuses for patterning the bottom surface of a light guiding plate. In the disclosure, a plurality of pins of a V-cutter are inserted into the surface of the light guiding plate in a certain depth. A driver is used to drive the V-cutter in motion relative to the light guiding plate in a certain direction, so that a plurality of V-shaped grooves are formed by the pins on the surface of the light guiding plate. The pattern density of the grooves on the surface of the light guiding plate is gradually increased from one end nearer the lamp to the other end far away from the lamp, so that the uniformity of the light dispersed from the light guiding plate is increased.

However, the light guiding plate is fixed to a predetermined position in the prior art and a plurality of the V-shaped grooves are formed on the surface of the light guiding plate by driving the cutter. The pattern quality of these grooves is affected by the cutter due to vibration during the continuous scraping process. Moreover, the pins are fixed to the conventional cutter, the pattern of these grooves formed by the cutter is also fixed. The shape, density, or depth of grooves formed by the cutter are fixed. Sometimes, U-shaped grooves might be better than V-shaped grooves for some kinds of light guiding plates. In addition, the density and depth of these grooves may need to be adjusted because of different materials of the light guiding plates or non-uniform brightness of lamps. However, the conventional device for patterning light guiding plates cannot provide the above-mentioned functions, and thus affects the quality of the back light module.

In view of the above, those skilled in this art endeavor to improve the apparatus for patterning the optical elements such as a light guiding plate and an optical film, etc. so as to form patterns on the optical element with better quality, and thus to solve the problems occurred in the prior art.

SUMMARY OF THE INVENTION

The primary objective of the present invention is to provide a device for patterning an optical element, which device can adjust the cutting tools thereof and produce uniform patterns on the optical element. Therefore, a back light module of a display with such an optical element can have better optical quality.

The second objective of the present invention is to provide a device for patterning an optical element, wherein the cutting tools of the device are moveable and adjustable. Therefore, the shape, density and depth of the cutting tools can be changed to form desired patterns on the optical element.

The device disclosed in this invention includes a working platform, a linear cutting pedestal, at least a cutting tool, at least a weight sliding block and a shaft. An optical element to be patterned is carried on the working platform. The optical element can be a light guiding plate or a diffusion film. The working platform is driven to move linearly and horizontally. The linear cutting pedestal is mounted above the working platform. An upper sliding track in which the weight sliding blocks can move back and forth is disposed at the top of the linear cutting pedestal. A lower sliding track in which the cutting tools can move back and forth is disposed at the bottom of the linear cutting pedestal. Each of the weight sliding blocks disposed at a specific position on the linear cutting pedestal corresponding to each of the cutting tools has a specific weight and produces a press force in a certain extent. Hence, in the device of this invention, the shape of the cutting tools can be modified, or the density and depth thereof can be adjusted according to the desired patterns for the optical element. The shaft is positioned above the linear cutting pedestal and drives the linear cutting pedestal to move vertically.

Adjustment of the cutting tools in shape, density and depth is firstly carried out based on patterns desired for the optical element. Then, the weight sliding blocks are adjusted to appropriate positions corresponding to the cutting tools such that each of the cutting tools at the bottom of the linear cutting pedestal can provide a uniform final press force to the optical element. Afterwards, the linear cutting pedestal is driven to cut out uniform grooves on the optical element. Therefore, the back light module of the display with the optical element has enhanced optical quality.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The present invention relates to a device for patterning an optical element wherein the optical element is a light guiding plate or a diffusion film, etc. In this invention, the best mode in which a light guiding plate is used as the optical element is described below in detail.

Figure 1:
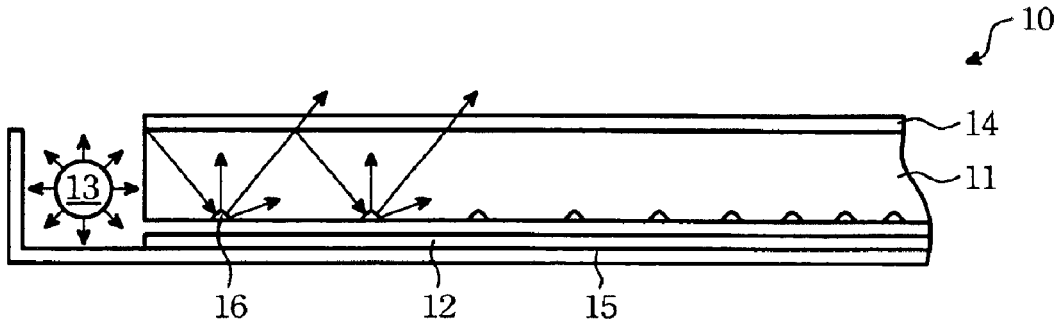
FIG. 1 (Prior Art)
FIG. 1 is a sectional view of a back light module in the prior art.
Figure 2:
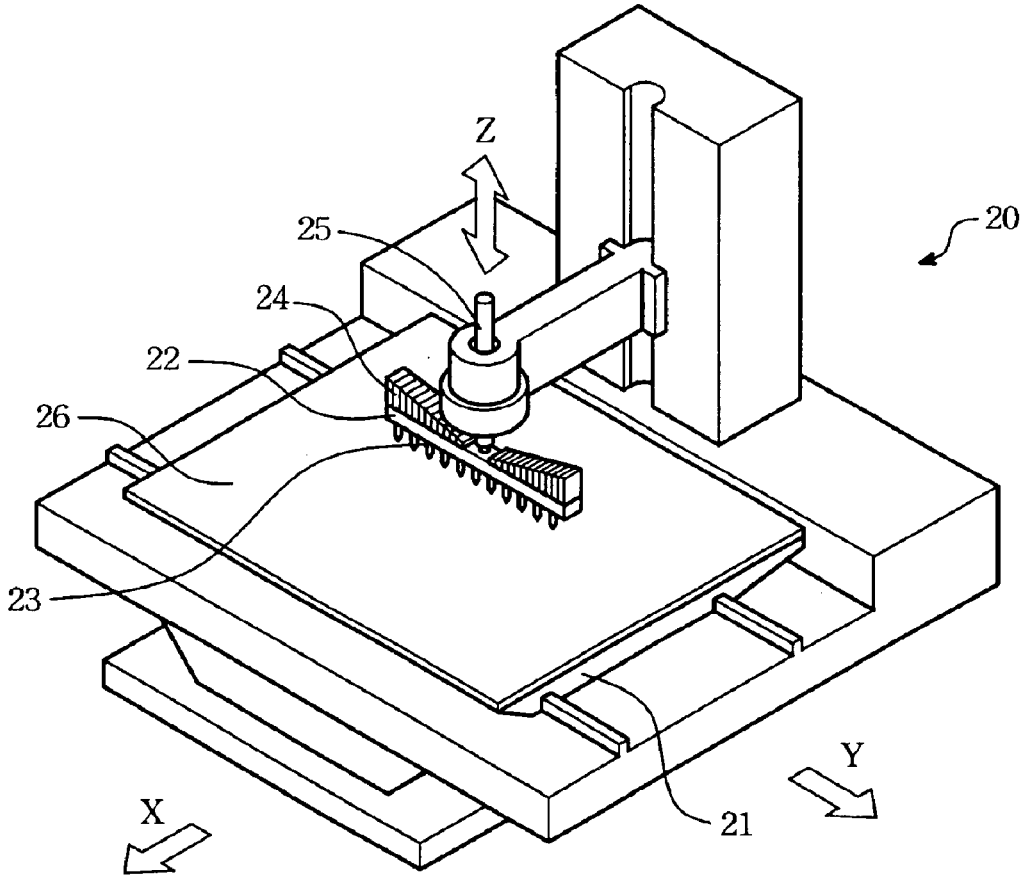
FIG. 2 is a schematic perspective diagram illustrating one embodiment of a device for patterning an optical element in accordance with this invention.

Please refer to FIG. 2, which is a schematic perspective diagram illustrating one embodiment of the device for patterning an optical element in accordance with this invention. The device includes a working platform 21, a linear cutting pedestal 22, a plurality of cutting tools 23, a plurality of weight sliding blocks 24 and a shaft 25. An optical element to be patterned, such as a light guiding plate 26 is carried on the working platform 21. A X driving device (not shown) and a Y driving device (not shown) are mounted below the working platform 21 and can respectively drive the working platform 21 and the optical element thereon to move linearly in the X direction and in the Y direction.

Figure 3A:
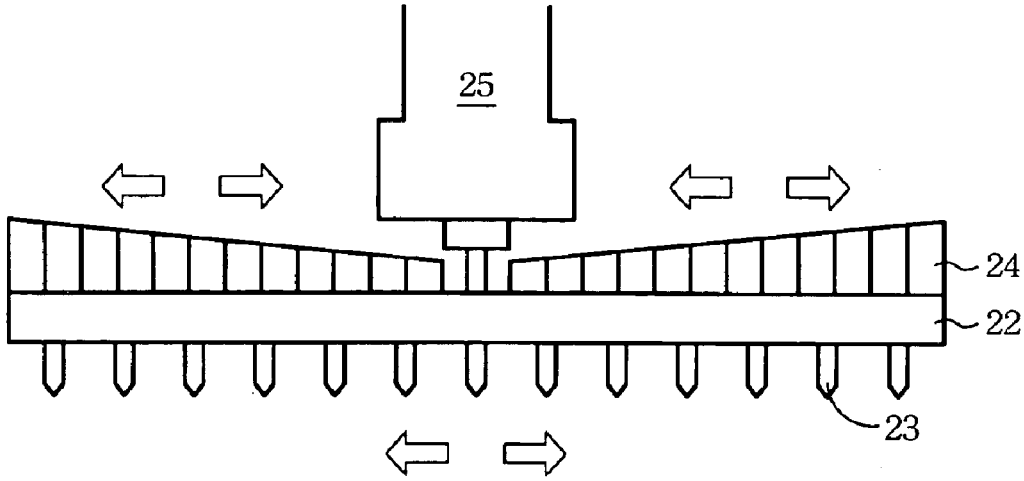
FIG. 3A is a front view of a linear cutting pedestal of this invention.
Figure 3B:
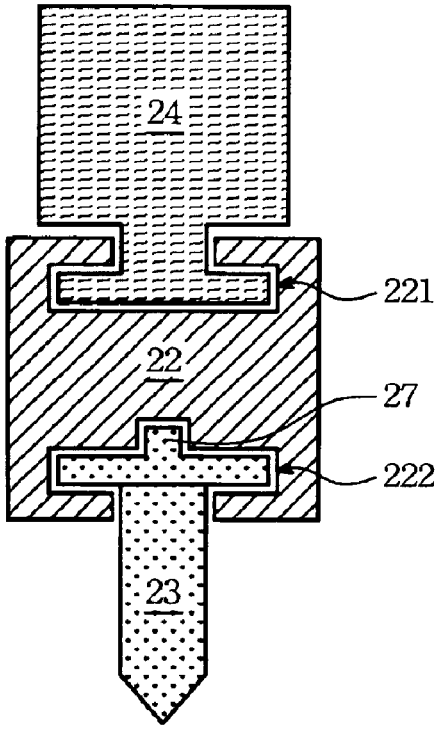
FIG. 3B is a side view of the linear cutting pedestal of this invention.

Referring to FIGS. 3A and 3B, the linear cutting pedestal 22 is mounted above the working platform 21 and is parallel to the surface thereof. The plurality of cutting tools 23 can move back and forth and be substituted from a lower sliding track 222, and the lower sliding track is disposed at the bottom of the linear cutting pedestal 22. Each of the cutting tools 23 provides a first press force. The plurality of weight sliding blocks 24 can move back and forth in an upper sliding track 221, and the upper sliding track 221 is disposed at the top of the linear cutting pedestal 22. Each of the weight sliding blocks 24 having a specific weight is disposed corresponding to each of the cutting tools 23 and produces a second press force in a certain extent. By means of the linear relative motion of the working platform 21 to the cutting tools 23, the cutting tools 23 of the device cut out grooves on the light guiding plate 26. The second press force provided by the weight sliding block 24 can balance the first press force of the cutting tool 23 such that uniform patterns can be formed by the cutting tools 23.

Figure 4:
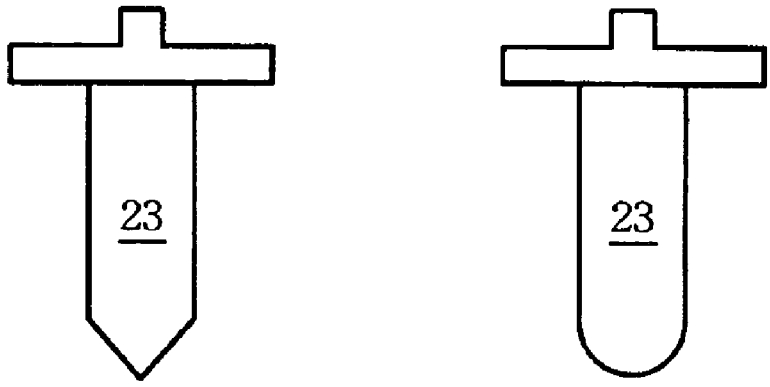
FIG. 4 is a schematic diagram illustrating the shapes of the cutting tool in accordance with this invention.
Figure 5:
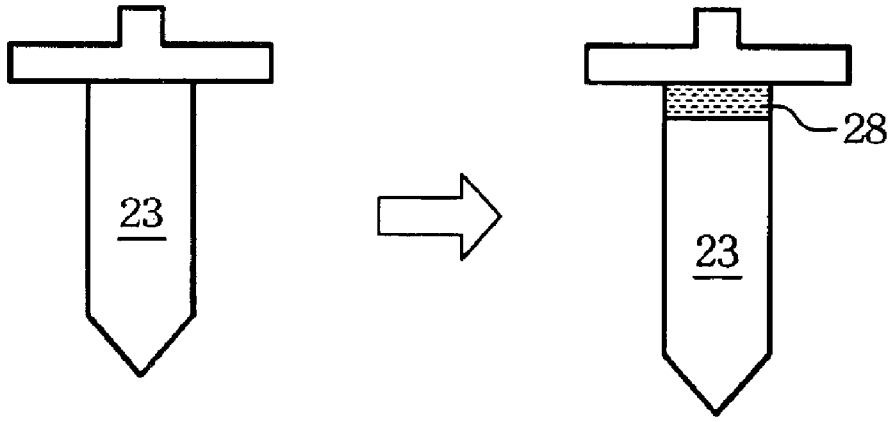
FIG. 5 is a schematic diagram illustrating adjustment of the depth of the cutting tool in the optical element by a pad in accordance with this invention.

Moreover, the shape of the cutting tools 23 in this invention can be modified, and the density and depth of cutting tools 23 can also be adjusted for the light guiding plate 26. The cutting tool 23 can be a V shape or a U shape, as shown in FIG. 4. The adjustment in the density of the cutting tools 23 is related to the arrangement of the cutting tools 23 in the lower sliding track 222. After each of the cutting tools 23 is moved to an appropriate position, it is fixed with a fixer 27. The fixer 27 can be a bolt or clamp, etc. The depth of the cutting tool 23 can be adjusted with a pad 28, as shown in FIG. 5. Furthermore, the shaft 25 positioned in the middle above the linear cutting pedestal 22 can drive the linear cutting pedestal 22 to move vertically (i.e. Z direction).

First, the liner cutting pedestal 22 is moved downwardly by the shaft 25 so that the cutting tools 23 at the bottom of the linear cutting pedestal 22 can insert into the light guiding plate 26 by an appropriate depth. Then, the shaft 25 is fixed. Afterwards, the working platform 21 and the light guiding plate 26 is driven by the X driving device (or the Y driving device) to move linearly in the X direction (or in the Y direction) so that the cutting tools 23 can cut out grooves on the light guiding plate 26.

It is noted from the above-mentioned that the patterning device of this invention has the following advantages.

1. When the cutting tools cut out grooves on the light guiding plate, the linear cutting pedestal is fixed to the patterning device, and the working platform and the light guide plate are drove to move. Thus, the vibration of the cutting tool during the cutting process is smaller. In the prior art, the light guiding plate is fixed and the cutter is moved, and thus the vibration of the cutter is larger. Hence, this invention can reduce vibration during cutting and obtain patterns of better quality.

2. The fixers of the cutting tools in the lower sliding track can be adjusted according to a desired pattern density. Therefore, the patterning device of this invention can form patterns of different densities. Conversely, the pins of the cutter in the prior art are fixed and the pattern density is unchangeable.

3. The cutting tools in the linear cutting pedestal can be replaced in the invention. Therefore, the shape of the cutting tools can be changed according to the desired groove shape. In the prior art, the pins are fixed to the cutter and the groove shape is also fixed.

4. The linear cutting pedestal of this invention has the function of adjusting the depth of the cutting tools in the light guiding plate by means of adding pads such that grooves of different depths are formed on the light guiding plate. However, the depth of grooves formed in the prior art is unchangeable.

5. The press force of the linear cutting pedestal varies according the position of the weight sliding blocks, such that the cutting tools at the bottom of the linear cutting pedestal can produce uniform cutting forces to cut the light guiding plate. Therefore, the patterns of better quality can be obtained.

Figure 6A:
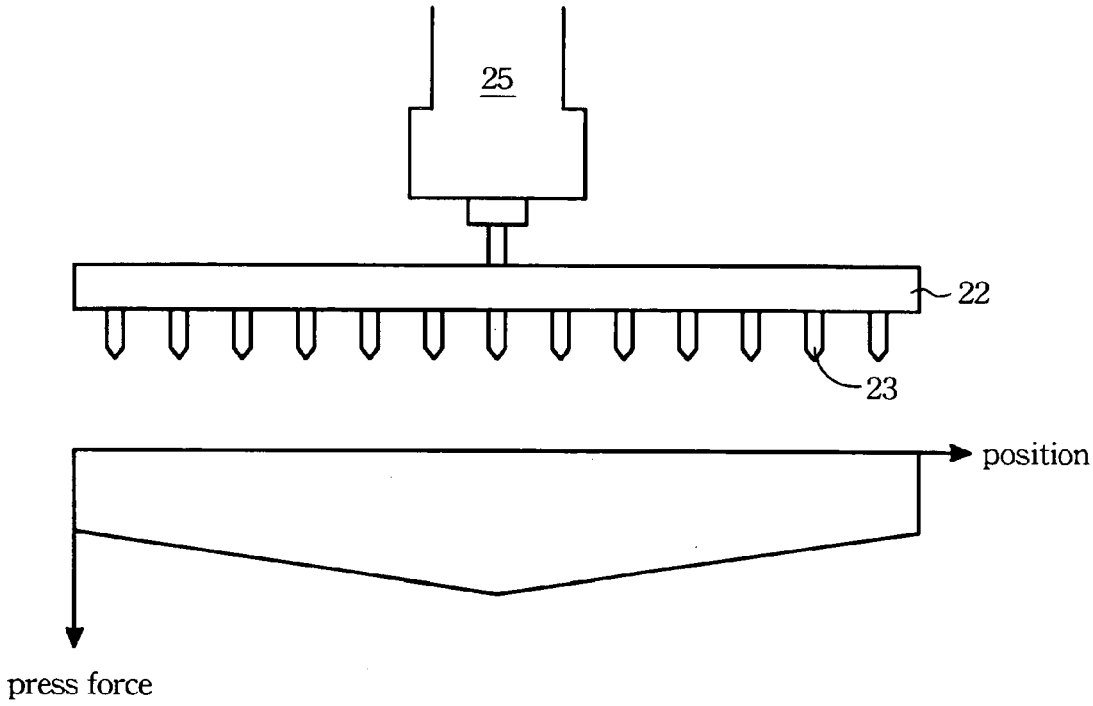
FIG. 6A is a schematic diagram illustrating the press forces produced by the cutting tools at the bottom of the linear cutting pedestal without the weight sliding blocks in accordance with this invention.
Figure 6B:
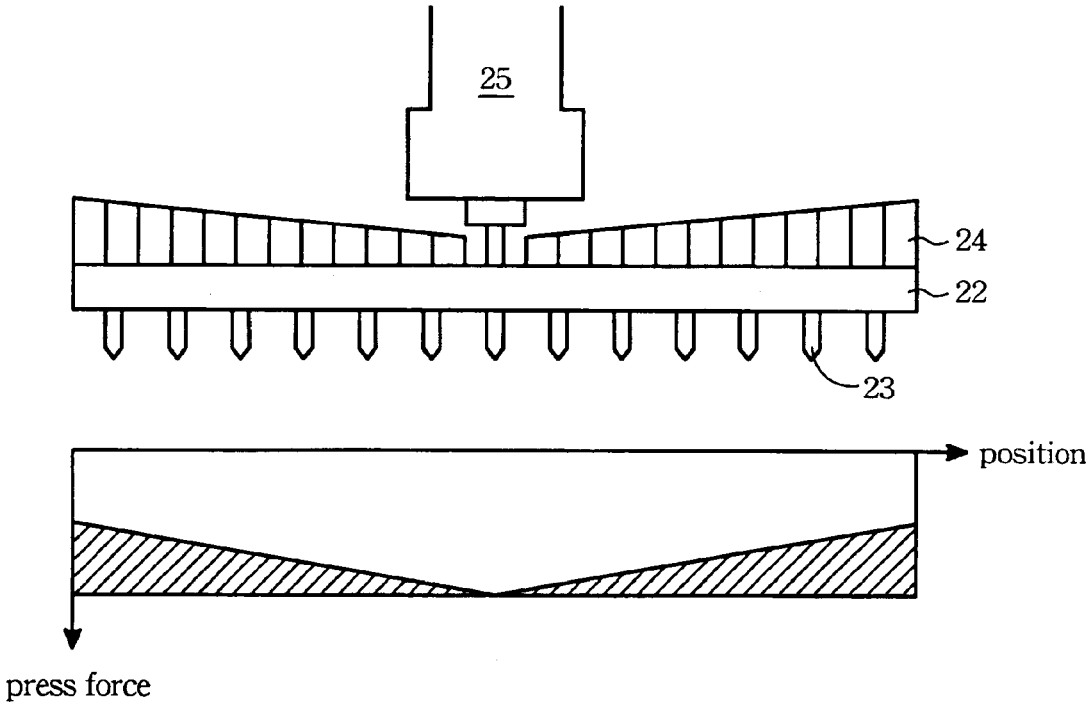
FIG. 6B is a schematic diagram illustrating the press forces provided by the cutting tools at the bottom of the linear cutting pedestal with the weight sliding blocks in accordance with this invention.

Further, referring to FIGS. 6A and 6B, the shaft is fixed to the middle of the linear cutting pedestal. After the linear cutting pedestal is driven by the shaft to insert the cutting tools into the light guiding plate, the press force is larger when the cutting tool is closer to the shaft, as shown in FIG. 6A. Hence, by modifying the positions of the weight sliding blocks at the top of the linear cutting pedestal, the press forces can be adjusted to balance the variations of the original press forces resulted from the different positions of the cutting tools. Therefore, each cutting tool at the bottom of the linear cutting pedestal can provide an equal final press force (i.e. cutting force) to produce patterns on the light guiding plate with uniformity and good quality. The oblique zone in FIG. 6B indicates the press forces produced by the weight sliding blocks. It is noted from FIG. 6B that the press forces produced by the weight sliding blocks in this invention are used to balance the variations of the original press forces of the cutting tools such that each cutting tool can provide an equal final press force (i.e. cutting force).

As is understood by a person skilled in the art, the foregoing preferred embodiment of the present invention is illustrated of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed:

1. A device for patterning an optical element, comprising:

a working platform, on which said optical element is carried, moving said optical element toward a first direction and a second direction;

a linear cutting pedestal mounted above said working platform, and having an upper sliding track at a top of said linear cutting pedestal and a lower sliding track at a bottom thereof;

a cutting tool positioned in said lower sliding track for moving back and forth in said lower sliding track, said cutting tool being adjusted to an appropriate position according to a predetermined pattern, and a first press force being provided by said cutting tool;

a weight sliding block, moving back and forth in said upper sliding track, and providing a second press force to said cutting tool; and a shaft, positioned above said linear cutting pedestal, driving said linear cutting pedestal to move in a third direction, and said third direction being perpendicular to said first direction and said second direction;

wherein the cutting tool is used to pattern said optical element by means of a linear relative motion between said working platform and said cutting tool, and said predetermined pattern is uniformly formed on the optical element by said first press force of said cutting tool and said second press force of said weight sliding block.

2. The device of claim 1, wherein said working platform has two driving axles for driving said working platform to move linearly.

3. The device of claim 1, wherein said optical element is a light guiding plate.

4. The device of claim 1, wherein said optical element is an optical film.

5. The device of claim 1, wherein said cutting tool is in a V shape.

6. The device of claim 1, wherein said cutting tool is in a U shape.

7. The device of claim 1, wherein said cutting tool is fixed to said lower sliding track by a fixer.

8. The device of claim 1, wherein a pad is used to adjust the depth of said cutting tool inserted into said optical element.

9. The device of claim 1, wherein said weight sliding block having a specific weight is disposed at a specific position of said linear cutting pedestal.

10. The device of claim 1, wherein in a manner of fixing said linear cutting pedestal and driving said working platform to move, said cutting tool at the bottom of said linear cutting pedestal forms said predetermined pattern on said optical element.

* * * * *